US005148726A

United States Patent [19]

Huebschen et al.

[11] Patent Number: 5,148,726

[45] Date of Patent: * Sep. 22, 1992

[54] ONE-PIECE, OPEN-END WRENCHING HEAD WITH ROUGHENED JAWS

[75] Inventors: David A. Huebschen; William T. Pagac; Frank Mikic, all of Kenosha, Wis.; Thomas S. Severson, Auburn Hills, Mich.; Douglas M. Sorbie, Salem, Wis.

[73] Assignee: Snap-on Tools Corporation, Kenosha, Wis.

[ * ] Notice: The portion of the term of this patent subsequent to Jun. 2, 2009 has been disclaimed.

[21] Appl. No.: 799,392

[22] Filed: Nov. 27, 1991

Related U.S. Application Data

[63] Continuation-in-part of Ser. No. 487,921, Mar. 5, 1990, Pat. No. 5,117,714, which is a continuation-in-part of Ser. No. 421,669, Oct. 16, 1989, abandoned.

[51] Int. Cl.[5] ..... B25B 13/02

[52] U.S. Cl. ..... 81/119; 81/186

[58] Field of Search ..... 81/119, 125.1, 186, 81/121, 122

[56] References Cited

U.S. PATENT DOCUMENTS

| | | | |
|---|---|---|---|
| 3,133,568 | 5/1964 | Reed | 81/900 |
| 3,242,775 | 3/1966 | Hinkle | 81/119 |
| 3,616,827 | 11/1971 | Stillwagaon, Jr. . | |
| 3,656,522 | 4/1972 | Ingimarsson . | |
| 4,778,730 | 10/1988 | Zucker | 81/900 |
| 5,074,171 | 12/1991 | Annis et al. | 81/119 |

FOREIGN PATENT DOCUMENTS

| | | | |
|---|---|---|---|
| 0228067 | 9/1959 | Australia | 81/119 |
| 1309258 | 10/1962 | France | 81/119 |
| 0080678 | 6/1934 | Sweden | 81/119 |
| 3886 | of 1882 | United Kingdom . | |
| 0508761 | 7/1939 | United Kingdom | 81/119 |
| 0644905 | 10/1950 | United Kingdom | 81/186 |
| 2063743 | 6/1981 | United Kingdom | 81/900 |

*Primary Examiner*—3203
*Assistant Examiner*—81/119
*Attorney, Agent, or Firm*—Emirch & Dithmar

[57] ABSTRACT

The open-end wrenching head includes two jaws and a throat interconnecting the jaws. The jaws include planar jaw driving surfaces each with a roughened region thereon adjacent to the throat and an unroughened region adjacent to the outermost end of the jaw driving surface, each of the roughened and unroughened regions being constructed and arranged to engage a portion of a selected side of a fastener. The throat may include either an arcuate surface or two planar throat driving surfaces. Each of the roughened regions has a coefficient of friction substantially greater than that of the unroughened regions and may be formed by deposition of an abrasive material by any of a number of processes or by deformation of the jaw driving surface by any of a number of processes.

27 Claims, 3 Drawing Sheets

10
12
14
16
18
20
22
24
24a
24b
25
26
26a
26b
27
28
29
29a
30
32
34
36
38
40
42
43
44
45
48
49
50
51
52
53
A
B

ONE-PIECE, OPEN-END WRENCHING HEAD WITH ROUGHENED JAWS

CROSS-REFERENCE TO RELATED APPLICATIONS

This is a continuation-in-part of Applicants' application, Ser. No. 487,921, now U.S. Pat. No. 5,117,714 filed Mar. 5, 1990, and entitled "One-Piece, Open-End Wrenching Head with Serrated Jaws", which is in turn a continuation-in-part of application Ser. No. 421,669, filed Oct. 16, 1989, and entitled "One-piece, Open-end Wrenching Head with Serrated Jaws," now abandoned, the disclosures of both of which applications are incorporated herein by reference.

BACKGROUND OF THE INVENTION

This invention relates generally to open-end wrenches and specifically to such a wrench including a wrenching head with driving surfaces having roughened or high-friction regions thereon.

A typical open-end wrench consists of an elongated handle and a wrenching head on either or both ends, the head including two jaws each with smooth planar driving surfaces that engage opposite sides of a polygonal fastener.

A disadvantage of such a wrench is the inadequate gripping force between the driving surfaces and the fastener. As a result, the wrench has a tendency to slip off the fastener when torque is applied thereto. That could be dangerous. Also, it increases stress in the fastener, tends to deform and spread the wrench jaws, and rounds and/or crushes the fastener corners.

SUMMARY OF THE INVENTION

It is a general object of the present invention to provide an improved open-end wrench which avoids the disadvantages of prior wrenches while affording additional structural and operating advantages.

An important feature of the invention is the provision of strong gripping force between the driving surfaces of the wrench and the surfaces of the fastener, thereby reducing the tendency of the wrench to slip off the fastener when torque is applied thereto.

Another feature is reduction of the stress on the fastener, the deformation and spreading of the jaws of an open-end wrench and the rounding and/or crushing of the fastener corners.

Another feature is to preclude contact of the wrench driving surfaces with the corners of the fastener, thereby reducing any rounding and/or crushing of the fastener corners.

A further feature of the invention is to increase the ultimate torque strength by tending to force the fastener toward the throat of the wrenching head.

The invention consists of these and other features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purposes of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

DESCRIPTION OF THE PREFERRED EMBODIMENTS

Figures 1, 2, 3:
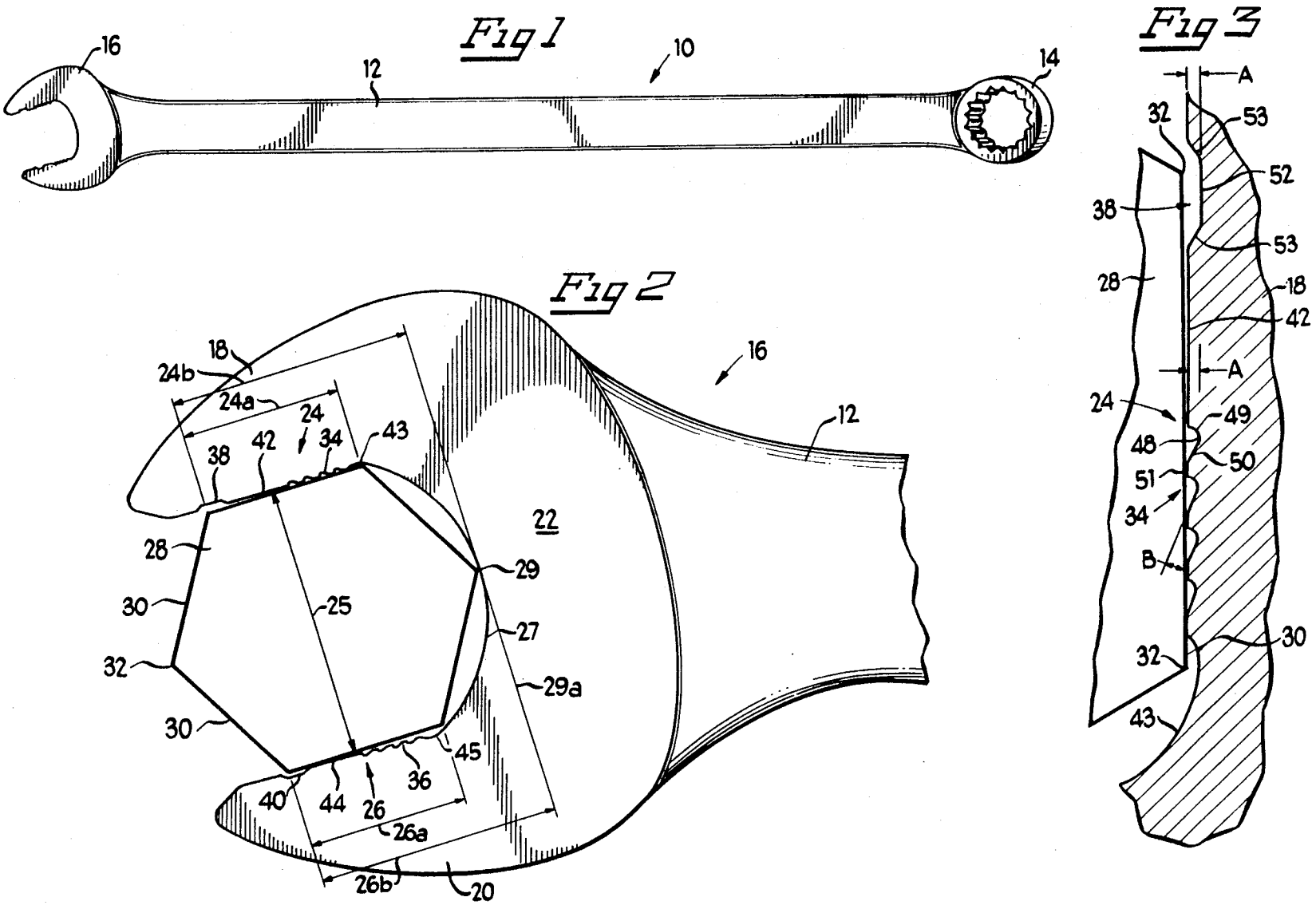
FIG. 1 is a perspective view of an open-end wrench incorporating a first embodiment of the present invention.
FIG. 2 is an enlarged, fragmentary view of the open-end wrench shown in FIG. 1, having a fastener located therein.
FIG. 3 is a greatly enlarged, fragmentary view of a portion of one of the jaws of the open-end wrenching head of FIGS. 1 and 2, together with an adjacent portion of the fastener.

Referring now to the drawings, and more particularly to FIG. 1 thereof, there is depicted a one-piece, open-end wrench 10, which comprises an elongated handle 12 and one-piece, box wrenching head 14 and open-end wrenching head 16. In this description, the term "open-end wrenching head" includes the heads of such tools as so-called "flare-nut" wrenches and "ratcheting open-end" wrenches. As shown in FIG. 2, the wrenching head 16 includes two jaws 18 and 20 and a throat 22. The jaws 18 and 20, respectively, include jaw driving surfaces 24 and 26. The throat 22 includes an arcuate surface 27 which interconnects surfaces 24 and 26. An arcuate throat has reduced stress concentration as compared to a V-shaped throat. A fastener 28 having a plurality of generally flat sides 30 intersecting in a plurality of corners 32 is located between surfaces 24 and 26. A corner of the fastener 28 contacts the deepest point 29 of surface 27. Surfaces 24 and 26 are spaced apart a distance 25 slightly greater than the across-sides dimension of the fastener 28 such that surfaces 24 and 26 simultaneously engage opposite sides 30 of the fastener 28.

Surface 24 has a roughened or high friction region 34 near one end thereof, a non-roughened or low friction, generally planar region 42 and a relief region 38 near the other end. Surface 24 also has an arcuate relief region 43 at the intersection with the throat surface 27. Surface 24 extends from the adjacent end of arcuate surface 27 of throat 22 a distance 24*a* substantially equal to the length of a side 30 of fastener 28. It is important that roughened region 34 be so located on surface 24 in order to be certain that such roughened region will necessarily engage the fastener when it is seated in the wrench head 16. The length or distance 24*a* is 0.578 times the distance 25 between surfaces 24 and 26. This factor is based on the fact that the side of a hexagonal fastener is inherently equal to 0.578 times the across-sides dimension of such fastener. The outer end of surface 24 is a distance 24*b* from an imaginary line 29*a* which passes through the deepest point 29 of throat surface 27 and is substantially perpendicular to the surface 24 and 26. Based on the inherent configuration of a hexagonal fastener, the distance 24*b* is 0.866 times the distance 25 between surfaces 24 and 26. In the embodiment of FIG. 2, roughened region 34 is on that portion of surface 24 nearest surface 27.

Similarly, surface 26 has a roughened region 36, an unroughened region 44 and a relief region 40. Surface 26 has an arcuate relief region 45 at the intersection with the throat surface 27. Surface 26 extends from the adjacent end of arcuate surface 27 of throat 22 a distance 26*a*. The outer end of surface 26 is a distance 26*b* from line 29*a*. It is important that roughened region 36 be so located on surface 26 in order to be certain that such roughened region will necessarily engage the fastener while it is seated in wrench head 16. Again, the length or distance 26*a* is 0.578 times the distance 25 between surfaces 24 and 26, and the distance 26*b* is 0.866 times distance 25. In this embodiment, roughened region 36 is on that portion of surface 26 nearest throat surface 27.

Referring to FIG. 3, the roughened region 34 is serrated and includes a plurality of asymmetrical grooves 48 which extend a depth A into surface 24, and may be formed by deformation of surface 24, as by a suitable broach during formation of the jaws 18 and 20. Each groove 48 has a curved segment 49 and a substantially straight segment 50, the latter being at an angle B with respect to the surface 24. Between adjacent grooves 48 are lands 5;. In an operative embodiment, the depth A is on the order of 0.006 inch for a wrenching head used on a fastener having an across-sides dimension of 0.5 inch or less, and on the order of 0.01 inch for a 1 inch head. The angle B was 20°.

The jaw relief region 38, in the particular embodiment depicted, includes a substantially planar bottom surface 52 extending a depth A into surface 24 and diverging side walls 53. The relief region 38 receives a corner 32 of the fastener 28 during counterclockwise rotation of the wrench, and this prevents such corner from engaging surface 24, thereby preventing rounding and crushing of such corner.

The roughened region 36 and the relief region 40 of surface 26 are identical in structure, respectively, to the roughened region 34 and the relief region 38 of surface 24, described in FIG. 3.

When the wrenching head 16 is rotated in the clockwise direction, initially there will be 1° or 2° of "free" swing or rotation because surfaces 24 and 26 do not engage the fastener sides 30. Upon further rotation, one or more of the lands 51 (FIG. 3) of the roughened region 34 will engage the adjacent portion of the fastener side to provide a gripping action. The unroughened, generally planar region 44 on surface 26 engages the opposite portion of the opposite fastener side. The relief regions 40 and 43 receive opposite fastener corners, so that such corners are not contacted and thus not damaged.

When the wrenching head 16 is rotated in the counterclockwise direction, one or more of the lands of the roughened region 36 on surface 26 engages the adjacent fastener side 30, while the unroughened region 42 on surface 24 will engage the opposite fastener side. The relief regions 38 and 45 receive opposite fastener corners to minimize damage to them.

Figure 4:
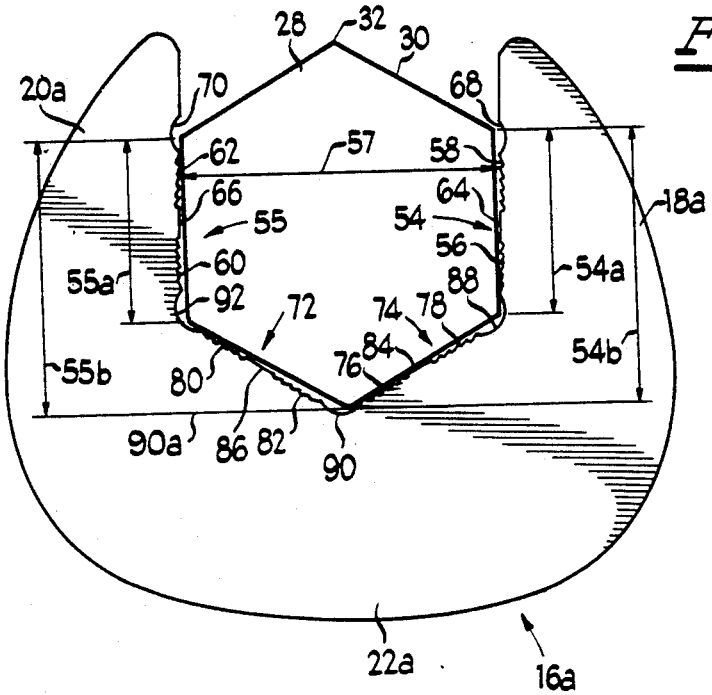
FIG. 4 is an enlarged, fragmentary view of an open-end wrenching head incorporating a second embodiment of the present invention.

FIG. 4 shows a wrenching head 16*a*, which includes jaws 18*a* and 20*a* and a throat 22*a*. The jaws 18*a* and 20*a* respectively have jaw driving surfaces 54 and 55. Surfaces 54 and 55 are spaced apart a distance 57 slightly greater than the across-sides dimension of fastener 28. For the same reasons explained above with respect to the embodiment of FIG. 2, surfaces 54 and 55 respectively have lengths 54*a* and 55*a* equal to 0.578 times the distance 57 between surfaces 54 and 55.

The outer ends of surfaces 54 and 55 are distances 54*b* and 55*b*, respectively, from an imaginary line 90*a* which passes through the deepest point 90 of the throat defined generally by the intersection of surfaces 72 and 74 and is substantially perpendicular to the surfaces 54 and 55. Based on the inherent configuration of a hexagonal fastener, the distances 54*b* and 55*b* are 0.866 times distance 57. The surface 54 has a pair of serrated regions 56 and 58, and the surface 55 has a pair of serrated regions 60 and 62. Each of the serrated regions 56, 58, 60 and 62 has a plurality of unidirectional, asymmetrical grooves like those depicted in FIG. 3. The grooves in the region 56 are oriented in a direction opposite to the grooves in the region 58 to assure a maximum gripping force irrespective of the direction in which the wrenching head 16 is rotated. The grooves in the regions 60 and 62 are likewise oppositely directed. A planar land 64 is between the serrated regions 56 and 58, and a planar land 66 is between the serrated regions 60 and 62.

The jaw driving surfaces 54 and 55, respectively include semicircular jaw relief regions 68 and 70. The regions 68 and 70 receive the corners 32 of the fastener 28 so that they do not contact the jaw driving surfaces 54 and 55 upon rotation of the wrench.

The throat 22*a* has planar throat driving surfaces 72 and 74, each at a preferred angle of 120° to the adjacent jaw driving surfaces 54 and 55. Surfaces 72 and 74 each have a length of approximately 0.578 times distance 57. The throat driving surface 74 has a pair of serrated regions 76 and 78 interconnected by a planar land 84 while the throat driving surface 72 has a pair of serrated regions 80 and 82 interconnected by a planar land 86.

Each of the serrated regions 76, 78, 80 and 82 has a plurality of unidirectional, asymmetrical grooves like those depicted in FIG. 3. A relief region 88 is between surfaces 54 and 74, a relief region 90 is between surfaces 72 and 74, and a relief region 92 is between surfaces 55 and 72. Each of the relief regions 88, 90 and 92 has a semicircular surface. The relief regions 68, 70, 88, 90 and 92 receive fastener corners, and thereby prevent them from contacting the jaw driving surfaces 54 and 55 and the throat driving surfaces 72 and 74 upon rotation of the wrench.

In order to use a wrench incorporating the head 16*a* of FIG. 4 to tighten a fastener, it is rotated clockwise 1 to 2° of "free" swing. Four sides of the fastener are respectively engaged by one or more flats of the serrated regions 56, 62, 76 and 80, to tightly grip the fastener and thereby minimize the chance of the wrench slipping off the fastener sides and thereby maximize the amount of torque which can be applied. If the wrenching head 16*a* is rotated in the counterclockwise direction, the four fastener sides are engaged by one or more flats of the serrated regions 60, 82, 78 and 58. Whether rotated in either direction, corners of the fastener are received in the relief regions 68, 88, 90, 92 and 70 to prevent damage to such corners.

Figure 5:
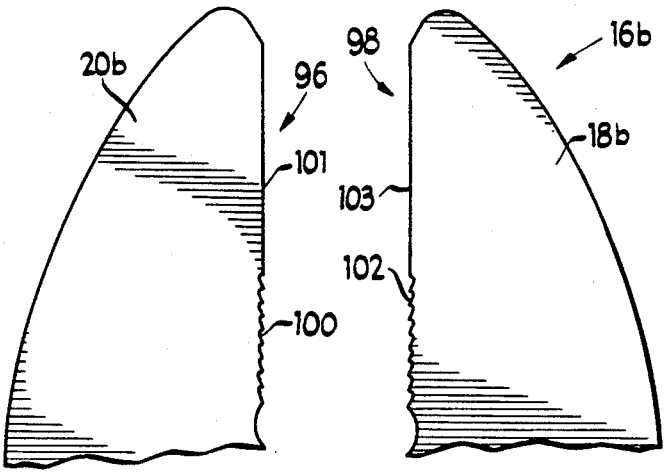
FIG. 5 is an enlarged, fragmentary view of the jaws of an open-end wrenching head incorporating a third embodiment of the present invention.

A wrenching head 16*b* is shown in FIG. 5 and includes jaws 18*b* and 20*b*, respectively having jaw driving surfaces 98 and 96. The jaw driving surface 96 has a roughened region 100 and an unroughened, generally planar region 101. The jaw driving surface 98 has a roughened region 102 and an unroughened, generally planar region 103. The unroughened, generally planar regions 101 and 103 are laterally aligned and the roughened regions 100 and 102 are laterally aligned. The throat connecting the jaws 18*b* and 20*b* may be arcuate as in FIG. 2 or V-shaped as in FIG. 4. The jaw driving surfaces 96 and 98 have no relief regions. The roughened regions 100 and 102 are serrated, comprising a number of grooves which may be formed in the same manner as was described above in connection with FIGS. 1-3.

Figure 6:
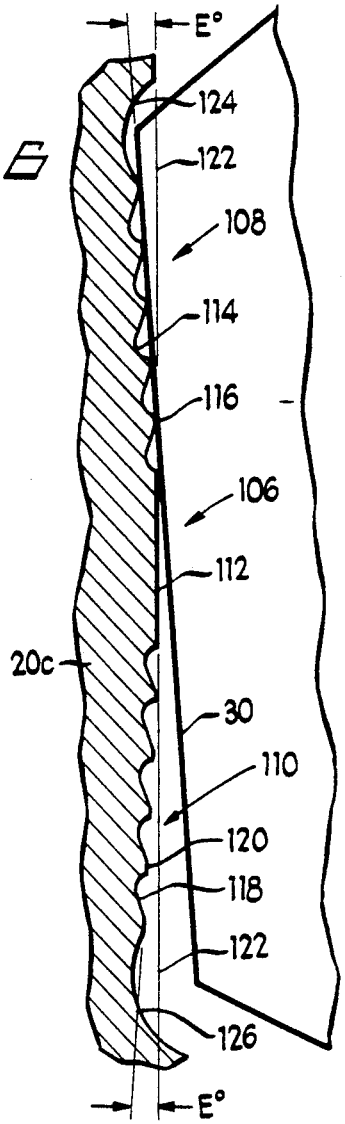
FIG. 6 is a greatly enlarged, fragmentary view of a portion of the jaws of an open-end wrenching head incorporating a fourth embodiment of the invention, together with an portion of the fastener.

Depicted in FIG. 6 is a jaw 20*c* including a jaw driving surface 106 having serrated regions 108 and 110 separated by a planar land 112. The serrated region 108 includes a plurality of grooves 114 alternating with a plurality of lands 116. The serrated region 110 includes a plurality of grooves 118 alternating with a plurality of lands 120. The grooves 114 and 118 are asymmetric, as shown in FIG. 3.

The land 112 defines the jaw driving surface of the jaw 20*c* and lies in a plane 122. The serrated regions 108 and 110 are at an angle E to the plane 122. Specifically, the angle between a plane defined by the lands 116 and the plane 122° is $-E°$. Similarly, the angle between a plane defined by the lands 120 and the plane 122 is $+E°$. The angle E is 1 to 3°. In an actual embodiment of the invention, the angle E was 2°.

The inclination of the serrated regions 108 and 110 provides surface-to-surface contact between the lands 116 or 120, as the case may be, and the sides 30 of the fastener 28. Without such angular orientation, rotation of the wrenching head, of which the jaw 20*c* is part, will result in fewer than all of the flats of one of the serrated regions 108 and 110 contacting the sides of the fastener as a result of the non-parallelism between such sides 30 and the jaw driving surfaces. The angular orientation of the serrated regions 108 and 110 increases parallelism between such serrated regions and the fastener sides such that upon clockwise rotation of the wrenching head, more (or all) of the lands 116 engage the fastener sides 30 to achieve maximum gripping force and thereby minimize slipping of the wrench. Counterclockwise rotation results in the lands 120 engaging the fastener sides.

At the end of the serrated regions 108 and 110 are relief regions 124 and 126 to receive corners of the fastener so that the jaw 20*c* does not contact such corners during tightening (relief region 124) and loosening (relief region 126).

Figure 7:
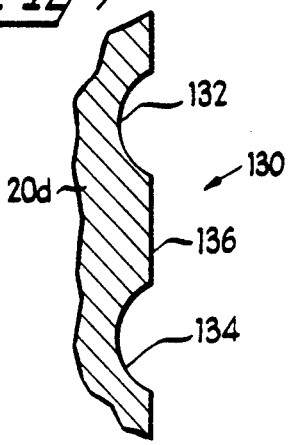
FIG. 7 is a greatly enlarged, fragmentary view of a portion of the jaws of an open-end wrenching head incorporating a fifth embodiment of the invention.

FIG. 7 shows a portion of a jaw 20*d* having a serrated region 130 including two symmetrical grooves 132 and 134 and a generally planar land 136 in between. The grooves 132 and 134 being semicircular, are easier to make.

Figure 8:
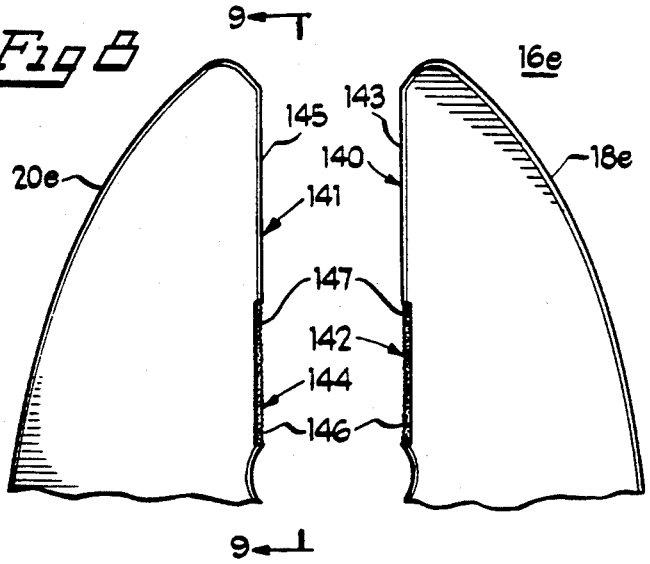
FIG. 8 is a view similar to FIG. 5, illustrating a sixth embodiment of the invention, wherein the roughened regions of the jaws are formed by deposition of an abrasive material.
Figure 9:
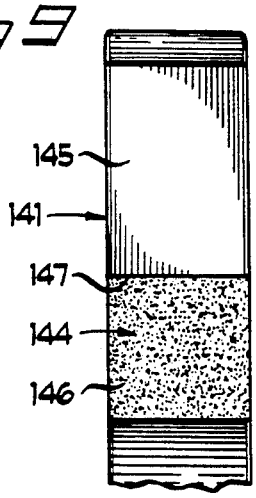
FIG. 9 is a view taken along the line 9—9 in FIG. 8.

FIGS. 8 and 9 show a wrenching head 16*e* which includes jaws 18*e* and 20*e*, respectively having jaw driving surfaces 140 and 141. The jaw driving surface 140 has a roughened, high-friction region 142 and an unroughened, low-friction, generally planar region 143. The jaw driving surface 141 has a roughened high-friction region 144 and an unroughened, low-friction, generally planar region 145. The unroughened, generally planar regions 143 and 145 are laterally aligned and the roughened regions 142 and 144 are laterally aligned. The throat connecting the jaws 18*e* and 20*e* may be arcuate, as in FIG. 2, or V-shaped as in FIG. 4. The roughened regions 142 and 144 are respectively disposed adjacent to the innermost ends of the jaw driving surfaces 140 and 141, i.e., adjacent to the throat (not shown) of the wrenching head 16*e*, and preferably have a length less than half that of the associated jaw driving surfaces 140 or 141, but is of sufficient length to assure engagement with a side of the associated fastener while it is seated in the wrench head 16*e*.

The roughened regions 142 and 144 are formed by deposition onto the jaw driving surfaces 140 and 141 of a layer 146 of a suitable abrasive material, such as tungsten carbide or the like. This deposition may be accomplished by any of a number of different processes. One such process is a sputter deposition process, wherein the abrasive material to be deposited is vaporized and deposited onto the jaw driving surfaces 140 and 141 in a known manner.

Alternatively, the deposition may be formed by an ion implantation technique, in which minute particles of the abrasive material is embedded in the jaw driving surfaces 140 and 141 at the molecular level.

Alternatively, the deposition may be formed by a brazing technique, wherein a first layer of material including particles of the abrasive material entrapped in a small amount of PTFE polymer is adhered to the jaw driving surfaces 140 and 141 and a second layer or braze cloth is then applied and the combination is bonded by heating, so that the braze infiltrates around the particles of abrasive material and forms a metallurgical bond with the jaw driving surfaces 140 and 141.

Alternatively, the abrasive material may be deposited on the jaw driving surfaces 140 and 141 by means of an adhesive bonding technique.

The deposited layer 146 may have a significant thickness. Accordingly, it may be deposited in recessed regions 147 of the jaw driving surfaces 140 and 141 which have a depth substantially equal to the anticipated depth of the layer 146, so as not to alter the spacing between the jaw driving surfaces 140 and 141.

Figure 10:
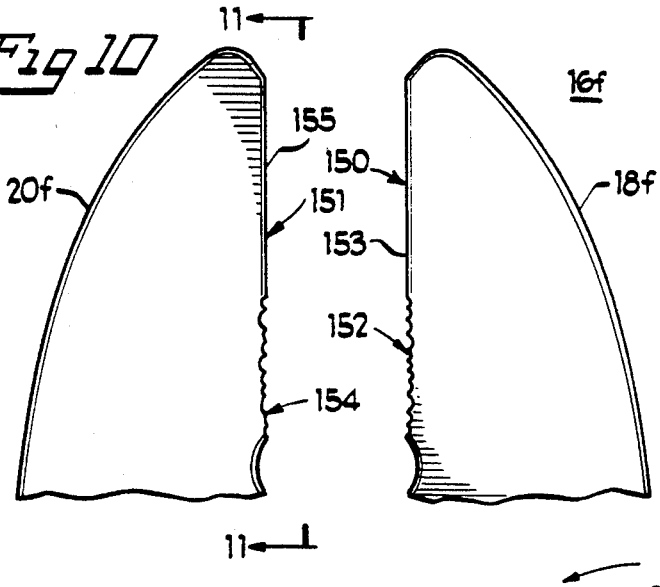
FIG. 10 is a view similar to FIG. 8, illustrating a seventh embodiment of the invention, wherein the roughened regions are formed by deformation of the jaws.
Figure 11:
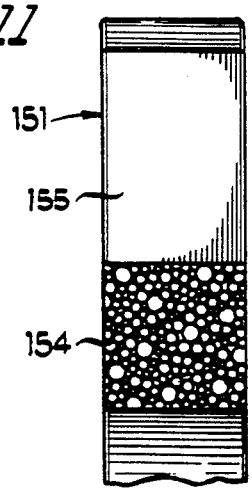
FIG. 11 is a view taken along the line 11—11 in FIG. 10.

Referring now to FIGS. 10 and 11, there is illustrated a wrenching head 16*f* which includes jaws 18*f* and 20*f*, respectively having jaw driving surfaces 150 and 151. The jaw driving surface 150 has a roughened region 152 and an unroughened, generally planar region 153. Similarly, the jaw driving surface 151 has a roughened region 154 and an unroughened, generally planar region 155. The wrenching head 16*f* is similar to the wrenching head 16*e*, described above in connection with FIGS. 8 and 9, except that the roughened regions 152 and 154 are formed by deformation of the jaw driving surfaces 150 and 151. This deformation may be accomplished by different processes.

One such process is by broaching during the formation of the jaws 18*f* and 20*f*, in a manner similar to that described above in connection with FIGS. 1-3. The broach may be designed to produce serrations, as illustrated in FIGS. 1-3 and 5 or, alternatively, may be designed to produce a more random roughness pattern, as illustrated in FIGS. 10 and 11. Alternatively, the roughened regions 152 and 154 may be formed by shot peening the jaw driving surfaces 150 and 151.

Figure 12:
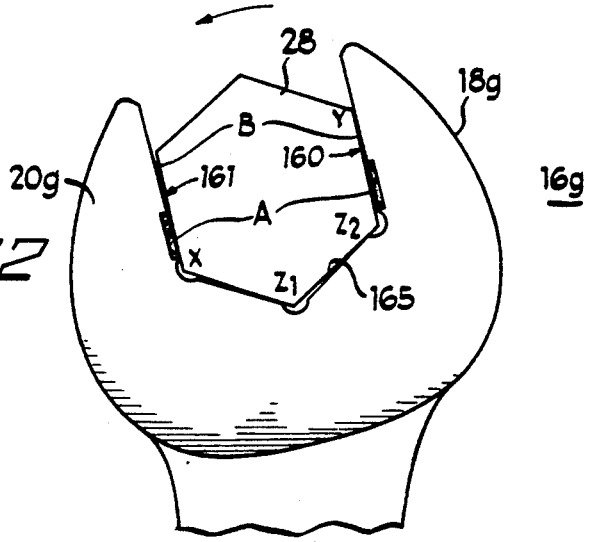
FIG. 12 is a diagrammatic view illustrating the principle of operation of the embodiments of FIGS. 2, 5, 8 and 10.

Referring now also to FIG. 12, the principles of operation of the invention will be explained. FIG. 12 diagrammatically illustrates a wrenching head 16*g*, having jaws 18*g* and 20*g*, respectively having jaw driving surfaces 160 and 161. However, the wrenching head 16*g* is intended to be generic to the wrenching heads 16, 16*b*, 16*e* and 16*f*, respectively illustrated in FIGS. 2, 5, 8 and 10. In operation, the jaws 18*g* and 20*g* are provided with roughened, high-friction regions A at the inner ends of the jaw driving surfaces 160 and 161 adjacent to the throat 165, and unroughened, low-friction regions B adjacent to the outermost ends of the jaw driving surfaces 160 and 161. The roughened regions A correspond to any of the roughened regions 34, 36, 100, 102, 142, 144, 152 and 154 and the unroughened regions B correspond to any of the unroughened regions 42, 44, 101, 103, 143, 145, 153 and 155 of the wrenching heads of FIGS. 2, 5, 8 and 10. The increased coefficient of friction in the roughened regions A causes these regions to grip the engaged side of the associated fastener more strongly than the unroughened regions B. Thus, for example, when the wrench is rotated in a counterclockwise direction, as viewed in FIG. 12, the low friction region B of the jaw 18*g* will tend to slip adjacent to the corner Y of the fastener 28, while the high friction region A of the jaw 20*g* will firmly grip the fastener 28 adjacent to its corner X. This will tend to pivot the fastener 28 about its corner X, and thereby tend to force the fastener 28 down into the high-strength throat 165 of the wrenching head 16*g*, where a portion of the reaction to the torque may be taken up adjacent to the corners Z1 and Z2. Since the greatest force will be imparted to the fastener 28 adjacent to the high-strength region of the wrenching head 16*g*, this will significantly reduce the tendency to spread the jaws 18*g* and 20*g* and thereby significantly increase the effective torque strength of the wrenching head 16*g*, i.e., the maximum torque which can be applied before the jaws will begin to spread.

The roughened regions A have a relatively high coefficient of friction, at least corresponding to an emery grit equivalent no greater than 100, and preferably corresponding to an emery grit equivalent in the range of from about 65 to about 45. The unroughened regions B, on the other hand, have a relatively low coefficient of friction typical of machined and hardened steel.

While the above-described deposition and deformation techniques for forming roughened regions A on the jaw driving surfaces have been described in connection with roughened regions disposed adjacent to the throat of the wrenching head, it will be appreciated that any of these techniques could also be used to form roughened regions adjacent to the outermost ends of the jaw driving surfaces. Thus, for example, any of these techniques could be used in place of serrations at the serrated regions 58 and 62 in FIG. 4 or the serrated region 108 in FIG. 6.

An open-end wrench constructed in accordance with the present invention has one alternative from each of four different aspects: a throat which is either arcuate or V shaped; jaw driving surfaces which are either parallel or inclined at an angle, such as 2°; jaw driving surfaces which are relieved or not relieved at the innermost and/or outermost ends thereof to protect the fastener corners; and roughened regions which are formed by any of a number of deposition processes, such as sputter deposition, brazing, adhesive bonding or ion implantation or by any of a number of deformation processes, such as shot peening or broaching. Many different combinations are possible.

From the foregoing, it can be seen that there has been provided an improved, open-end wrench including a wrenching head with jaw driving surfaces, each having a roughened region adjacent to the throat which amplifies the gripping action between the sides of the fastener and the driving surfaces of the wrenching head, and cooperates with a nonroughened region on the opposite jaw to tend to force the fastener into the throat of the wrenching head and, therefore, increase the amount of torque which can be applied without wrench slippage or jaw spreading. In certain embodiments, one or more relief regions avoid contact with the corners of the fastener.

We claim:

1. A one-piece, open-end wrenching head for a fastener having a plurality of generally flat sides intersecting at a plurality of corners, the fastener having an across-sides dimension, said wrenching head comprising two jaws of substantially equal length and a throat integrally interconnecting said jaws, said jaws including jaw driving surface portions spaced apart a predetermined distance slightly greater than the across-sides dimension of said fastener, the outermost end of each of said jaw driving surface portions being at a distance from the deepest point of said throat of at least 0.866 times the predetermined distance, at least one of said jaw driving surface portions having a roughened region thereon disposed adjacent to said throat and constructed and arranged to engage a portion of a side of the fastener, at least the other of said jaw driving surface portions having an unroughened region thereon disposed adjacent to said outermost end and constructed and arranged to engage a portion of a side of a fastener, said roughened region having a coefficient of friction substantially greater than that of said unroughened region.

2. The wrenching head of claim 1, wherein each of said jaw driving surface portions includes a relief region at said outermost end to receive a corner of the fastener, said relief region being disposed at a distance from the deepest point of said throat of substantially 0.866 times the predetermined distance.

3. The wrenching head of claim 1, wherein each of said jaw driving surface portions includes said roughened region thereon.

4. The wrenching head of claim 1, wherein said roughened region has a length no greater than one-half the length of the associated jaw driving surface portion.

5. The wrenching head of claim 1, wherein said roughened region is constructed and arranged to engage the fastener at or adjacent to a corner thereof.

6. The wrenching head of claim 1, wherein said roughened region comprises a deposit of an abrasive material on the associated jaw driving surface portion.

7. The wrenching head of claim 6, wherein said roughened region is formed by the process of sputter deposition of the abrasive material.

8. The wrenching head of claim 6, wherein said roughened region is formed by the process of brazing the abrasive material to the associated jaw driving surface portion.

9. The wrenching head of claim 6, wherein said roughened region is formed by the process of adhesively bonding the abrasive material to the associated jaw driving surface portion.

10. The wrenching head of claim 6, wherein said roughened region is formed by the process of ion implantation of the abrasive material on the associated jaw driving surface portion.

11. The wrenching head of claim 1, wherein said roughened region includes a deformed region of the associated jaw driving surface portion.

12. The wrenching head of claim 11, wherein said deformed region is formed by the process of shot peening.

13. The wrenching head of claim 11, wherein said deformed region is -formed by the process of broaching.

14. The wrenching head of claim 13, wherein said deformed region includes a plurality of serrations.

15. The wrenching head of claim 1, wherein said roughened region has a coefficient of friction corresponding to an emery grit equivalent of no greater than 100.

16. The wrenching head of claim 15, wherein said roughened region has a coefficient of friction corresponding to an emery grit equivalent in the range of from about 65 to about 45.

17. The wrenching head of claim 1, wherein said unroughened region has a coefficient of friction corresponding to that of machined and hardened steel.

18. A wrench comprising: a handle; and a one-piece, open-end wrenching head on said handle for a fastener having a plurality of generally flat sides intersecting at a plurality of corners, the fastener having an across-sides dimension, said wrenching head including two jaws of substantially equal length and a throat integrally interconnecting said jaws, said jaws including driving surface portions spaced apart a predetermined distance slightly greater than the across-sides dimension of the fastener, the outermost end of each of said jaw driving surface portions being at a distance from the deepest point of said throat of at least 0.866 times the predetermined distance, at least one of said jaw driving surface portions having a roughened region thereon disposed adjacent to said throat and constructed and arranged to engage a portion of a side of the fastener, at least the other of said jaw driving surface portions having an unroughened region thereon disposed adjacent to said outermost end and constructed and arranged to engage a portion of a side of a fastener, said roughened region having a coefficient of friction substantially greater than that of said unroughened region.

19. In a one-piece, open-end wrenching head for a fastener having a plurality of generally flat sides intersecting at a plurality of corners, the fastener having an across-sides dimension, wherein the wrenching head includes two jaws and a throat interconnecting the jaws, the jaws including jaw driving surface portions spaced apart a predetermined distance slightly greater than the across-sides dimension of the fastener, the outermost end of each of the jaw driving surface portions being at a distance from the deepest point of the throat of at least 0.866 times the predetermined distance, at least one of the jaw driving surface portions having at least one roughened region thereon constructed and arranged to engage a portion of a side of the fastener, the improvement comprising: the roughened region being formed by the process of depositing an abrasive material on the jaw driving surface portion.

20. The wrenching head of claim 19, wherein said process of depositing includes sputter deposition.

21. The wrenching head of claim 19, wherein said process of depositing includes brazing of the abrasive material to the jaw driving surface portion.

22. The wrenching head of claim 19, wherein said process of depositing includes adhesive bonding of the abrasive material to the jaw driving surface portion.

23. The wrenching head of claim 19, wherein said process of depositing includes ion implantation.

24. In a one-piece, open-end wrenching head for a fastener having a plurality of generally flat sides intersecting at a plurality of corners, the fastener having an across-sides dimension, wherein the wrenching head includes two jaws and a throat interconnecting the jaws, the jaws including jaw driving surface portions spaced apart a predetermined distance slightly greater than the across-sides dimension of the fastener, the outermost end of each of the jaw driving surface portions being at a distance from the deepest point of the throat of at least 0.866 times the predetermined distance, at least one of the jaw driving surface portions having at least one roughened region thereon constructed and arranged to engage a portion of a side of the fastener, the improvement comprising: the roughened region being formed by the process of deformation of the jaw driving surface portion.

25. The wrenching head of claim 24, wherein said process of deformation includes broaching of the wrenching head during formation of the jaws.

26. The wrenching head of claim 24, wherein said process of deformation includes shot peening the jaw driving surface portion.

27. The wrenching head of claim 24, wherein said process of deformation includes formation of a plurality of serrations on the jaw driving portion.

* * * * *